US005167255A

United States Patent [19]

Göhring et al.

[11] Patent Number: 5,167,255

[45] Date of Patent: Dec. 1, 1992

[54] SANITARY FITTING

[75] Inventors: Claus-Peter Göhring, Stuttgart; Werner J. Weinmann, Filderstadt, both of Fed. Rep. of Germany

[73] Assignee: Hansa Metallwerke AG, Fed. Rep. of Germany

[21] Appl. No.: 824,096

[22] Filed: Jan. 22, 1992

[30] Foreign Application Priority Data

Jan. 25, 1991 [DE] Fed. Rep. of Germany ..... 4102134

[51] Int. Cl.[5] ..... F16K 11/085; F16K 27/00

[52] U.S. Cl. ..... 137/607; 137/625.41; 251/367

[58] Field of Search ..... 137/607, 625.41; 251/285, 367

[56] References Cited

U.S. PATENT DOCUMENTS

| | | | |
|---|---|---|---|
| 1,664,612 | 4/1928 | French | 251/367 X |
| 3,193,248 | 7/1965 | Lowrey | 251/367 X |
| 3,559,684 | 2/1971 | Rudewick | 251/285 X |
| 4,051,869 | 10/1977 | Holt et al. | 137/607 |
| 4,681,141 | 7/1987 | Wang | 137/607 |
| 4,741,363 | 5/1988 | Hu | 137/607 |
| 4,941,509 | 7/1990 | Orlandi | 251/285 |
| 5,050,641 | 9/1991 | Shwu-Fen | 137/607 |

FOREIGN PATENT DOCUMENTS

| | | | |
|---|---|---|---|
| 563100 | 5/1957 | Italy | 251/285 |

*Primary Examiner*—Stephen M. Hepperle
*Attorney, Agent, or Firm*—Fred Philpitt

[57] ABSTRACT

In a sanitary fitting controlled in a non-contacting manner, the housing is divided several times: handle-like attachments (6, 7) are detachably connected on both sides to a main housing (1), which contains the channels carrying water. One of the two handle-like attachments (6) holds all the electronic components, in particular transmitter (9), receiver (10) and receiving electronics (11) and receives these electronic components at least partly in its cup-shaped housing (52). The other handle-like attachment (7) similarly holds all the mechanical components, in particular the electrically controlled valve (14, 29), and receives these mechanical components at least partly in its cup-shaped housing (18) (FIG. 3).

15 Claims, 6 Drawing Sheets

SANITARY FITTING

The invention relates to a sanitary fitting controlled in a non-contacting manner, with a housing, in which are located:

a) substantially electronic components, in particular a transmitter, a receiver and an electronic switching circuit, which in a non-contacting manner ascertain the presence of a user in a detection range and after this produce an output signal;

b) substantially mechanical components, in particular an electrically controlled valve, which control the flow of water depending on the output signal of the electronic components and possibly other limiting quantities.

In the case of sanitary fittings controlled in a non-contacting manner, efforts are directed generally to locating all components, thus both the electronic as well as the mechanical components in a standard housing. Then for example it is no longer necessary, as was the case previously, to fit the electrical valves controlling the water flow separately from the actual fitting in the inlet pipes and to mount the necessary connecting cables. In known sanitary fittings of this type controlled in a non-contacting manner, on account of the plurality of components to be located, a block-like appearance, which is not very pleasant, results. Furthermore they are generally not very easy to service.

It is the object of the present invention to design a sanitary fitting of the aforementioned type, controlled in a non-contacting manner, so that it is easy to service, in which case it simultaneously acquires an attractive appearance.

This object is achieved according to the invention due to the fact that c) the housing comprises a main housing containing the water channels and two handle-like attachments releasably attached symmetrically with respect to a central plane, each with a substantially cup-shaped housing;

d) all the electronic components are held in the manner of a standard construction by one of the handle-like attachments and are located at least partly in its cup-shaped housing;

e) all the mechanical components are held in the manner of a standard construction by the other of the handle-like attachments and are located at least partly in its cup-shaped housing.

From the aesthetic point of view, the invention achieves the object set in the following manner: so called twin-handle fittings are known generally to the user, in which two handles for adjusting the hot or cold water flow are attached laterally to the fitting housing. Users have become used to the appearance of such fittings, whereof the design has reached a very high quality. Now, with the invention, the external appearance of such known and aesthetic twin-handle fittings is simulated for a sanitary fitting controlled in a non-contacting manner. What is perceived as a "handle" and tolerated aesthetically by the viewer, is in fact a housing extension, in which components are located. Due to this, space is saved in the central main housing, which is equated by the user with the fitting housing known to him, so that the housing can be kept more slender and more aesthetically attractive.

The ease with which servicing can be carried out is achieved by the present invention due to the fact that the three main components of the housing in each case contain only those components which fall "in one discipline": all the electronic components are combined as one structural unit on one of the side attachments. This structural unit falls within the area of competence of an electronic technician; it can first of all be produced by the latter at the factory, but then also if necessary serviced, repaired or exchanged altogether. Located in the central main housing are all the channels carrying water, which generally do not require special maintenance. On the other hand, in the second handle-like attachment, all the mechanical components are once more combined as a structural unit, which can be removed from the sanitary fitting as a whole likewise for servicing purposes and then easily repaired by the sanitary expert competent in this case, if necessary also it can be replaced altogether.

In many cases it is sufficient if the handle-like attachment is fastened to the main housing in a non-rotatable manner. In this way the handle-like attachment in fact serves solely as a housing extension, in which additional space is available for components. In particular the handle-like attachment in which the electronic components are located, will generally not be able to rotate.

The fastening of an attachment which is not able to rotate appropriately takes place so that a fastening ring is releasably attached in the open end of its housing and that the fastening ring is screwed to one side face of the main housing.

For reasons of accessibility, in this case the screws for the fastening ring advantageously extend transversely through the main housing. The non-rotatable attachment is thus fastened to the main housing with these screws from the opposite side, provided that the handle-like attachment to be located there has not yet been fitted.

However, at least one of the handle-like attachments may also be rotatable and in this respect serve as a genuine handle. In fact not all functions are carried out in a non-contacting manner in a fitting controlled in a non-contacting manner. It is quite customary and also acceptable for hygienic reasons that functional changes required infrequently, for example adjusting the temperature of the water flowing out, are carried out manually. This may take place with a rotatable, handle-like attachment according to the present invention, designed as a genuine handle. In which case obviously this rotatable attachment then entrains all the components attached thereto, in the rotation.

In the case of this most common design with a rotatable attachment, the latter advantageously holds a rotary piston, which projects into a chamber of the main housing by its region regulating the cold and hot water flow.

In this connection it is particularly space-saving if the rotary piston is constructed as a hollow piston and at least the closing members of the electrically controlled valve are located inside the hollow piston.

According to a particular feature of the present invention, the rotatable, handle-like attachment is screwed to the main housing by means of a U-shaped fastening part, which engages in a groove on a mechanical component held by the rotatable attachment. Thus, due to the U-shaped fastening part, the entire rotatable, handle-like attachment is fixed in the axial direction. Since this type of attachment takes place exclusively on the side face of the main housing where the rotatable, handle-like attachment is to be located, it is particularly suitable for combination with the above described type of attachment for a non-rotatable, handle-like attachment, which takes place with fastening screws extending through the entire main housing.

Naturally, with the type of fastening with a U-shaped fastening part, care must be taken that the fastening screws are in fact accessible. For this purpose, the component comprising the groove may comprise recesses leading to one side face, which may be brought into alignment with the fastening screws for the U-shaped fastening part. The rotatable attachment thus needs to be rotated only slightly in order that by way of the said recesses, the fastening screws are accessible for a screwdriver.

The rotatable attachment should be provided with means for limiting the angle of rotation. For this purpose, a mechanical component mounted thereon may comprise a recess, which forms a shoulder projecting radially from a core of the component, this shoulder, by abutment against a stationary part, limiting the rotatability of the attachment at least in one direction of rotation.

The angle of rotation should be adjustable in particular in the direction which corresponds to an increase in temperature. For this purpose, a stop member may be attached to an annular shoulder of the recess in different angular positions, which member by abutment against a stationary part, limits the rotatability of the attachment in this direction of rotation.

A fastening screw for mounting the rotatable attachment on the main housing may serve simply as a stationary part.

The cup-shaped housings of the handle-like attachments advantageously engage by their open ends or by a collar extending the latter, into a groove on the adjacent side face of the main housing. This produces a visually attractive transition between the two lateral, handle-like attachments and the main housing, which in addition no longer allows the user to know whether or not the respective, handle-like attachment is rotatable.

According to a further feature of the invention, the main housing is attached to the base part by a central screw.

In this case, the separating points between the inflow channels and the bores should be provided with appropriate seals and the head of the central screw should be sealed with respect to the main housing by a gasket.

One embodiment of the invention will be described in detail hereafter with reference to the drawings, in which.

Figure 1:
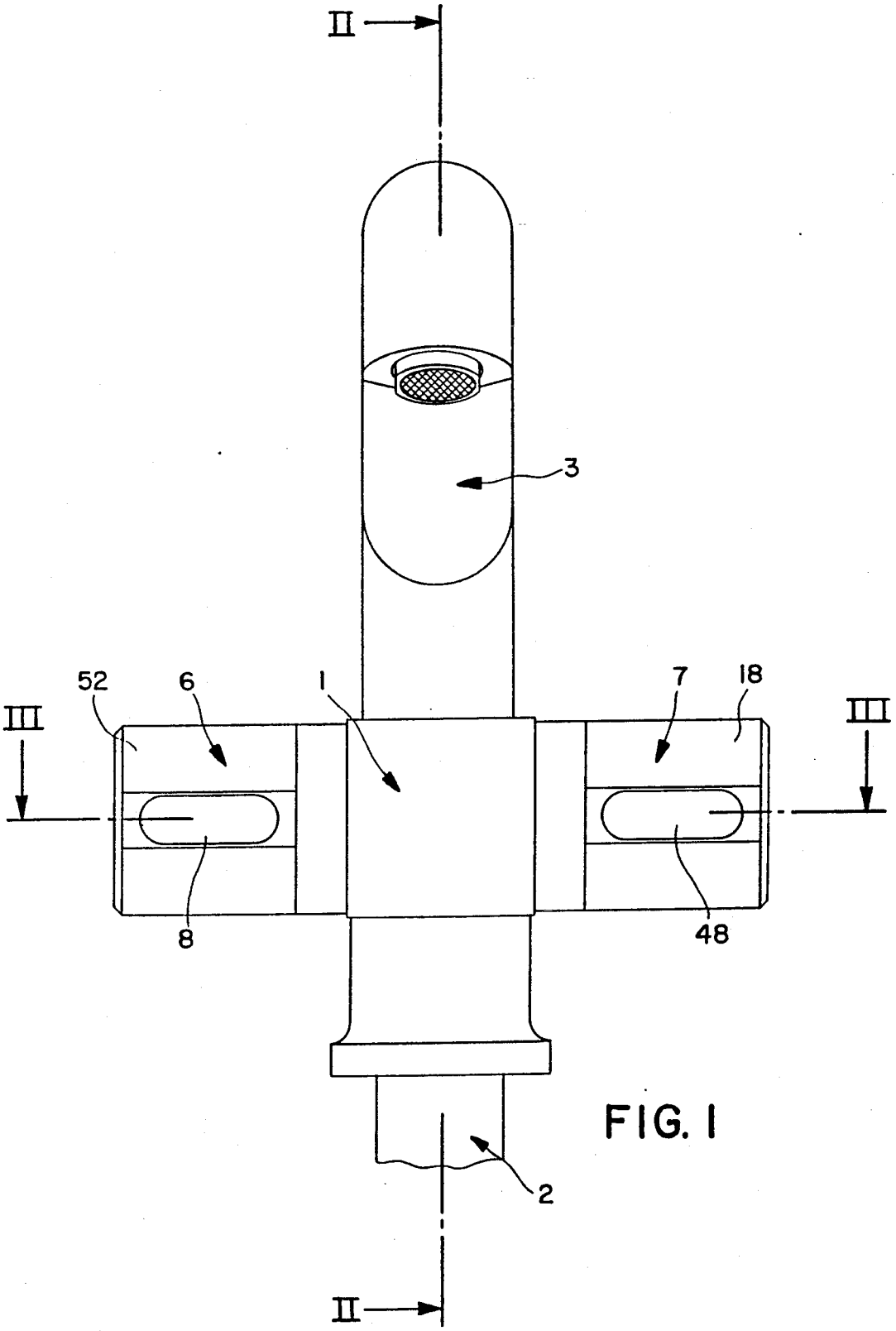
FIG. 1 is a front view of a sanitary fitting controlled in a non-contacting manner.

As can be seen from FIG. 1 of the drawings, the illustrated sanitary fitting controlled in a non-contacting manner can be divided into five main components:

A swivel outlet 3 is fitted onto a central main housing 1, to which a base part 2 is attached on the under side. Inlet channels 4 for hot and cold water (one of which is shown in broken line in FIG. 2) pass through the base part 2. Flexible water-supply hoses 5 are screwed into the latter from below.

Two handle-like attachments 6 and 7 are connected to the main housing 1 symmetrically with respect to the sectional plane II—II shown in FIG. 1.

Figure 3:
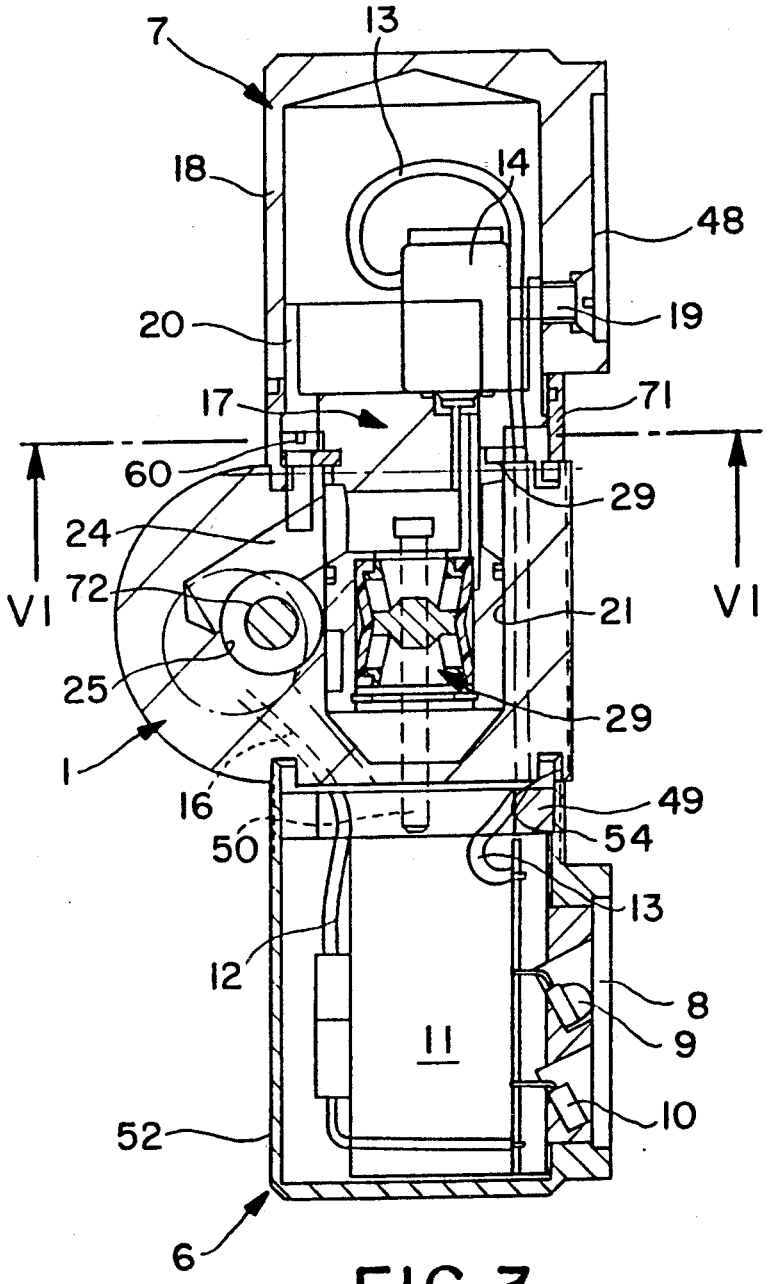
FIG. 3 is a sectional view on line III—III of FIG. 1.

The left-hand handle-like attachment 6 has solely the outer appearance, but not the function of a handle. It serves exclusively for receiving the electronic components of the fitting controlled in a non-contacting manner. In FIG. 1 and FIG. 3, the optical inlet and outlet window 8 for the infrared light used for detecting a user is illustrated. The window 8 is dark so that its function as an optical window and the emitting diode 9 as well as the receiving diode 10 located therebehind are not visible (see the sectional view of FIG. 3). FIG. 3 shows how the electronics 11 are located inside the handle-like attachment 6, to which electronics the supply voltage is supplied on the one hand by way of a cable 12 and which on the other hand are connected by way of a further cable 13 in a manner to be described hereafter, to a solenoid valve 14, which controls the flow of water. The cable 12 is guided out of the sanitary fitting by way of an axis parallel bore 15 in the main housing 1 or the base part 2 and an inclined bore 16 in the main housing 1.

The arrangement is obviously such that combined as one unit in the handle-like attachment 6 are all those components which can be referred to as "electronic" in the sense that they serve for the electrical detection of a user in front of the sanitary fitting and for the production of those signals by which a solenoid valve can be controlled.

In the embodiment illustrated, the right-hand handle-like attachment 7 is not solely "handle-like", thus not only looks like a conventional sanitary fitting handle, but in fact has this function. It can be rotated about its horizontal axis namely for adjusting the temperature of the mixed water flowing out of the sanitary fitting. In a sanitary fitting, which delivers exclusively water at a single temperature, the attachment 7 would also be solely handle "like", thus would not actually have the function of a handle, but would solely give the appearance of the presence of such a handle.

Located or mounted as a unit in the handle-like attachment 7 are all those components which serve to control the water flow and in this sense can be regarded as "mechanical". Belonging in particular to these mechanical components is a magnetically actuated pilot valve, whereof the construction will be described in detail hereafter, as well as a rotary piston 17, also known as a "friction member", combined structurally with the latter, for adjusting the temperature.

Figure 2:
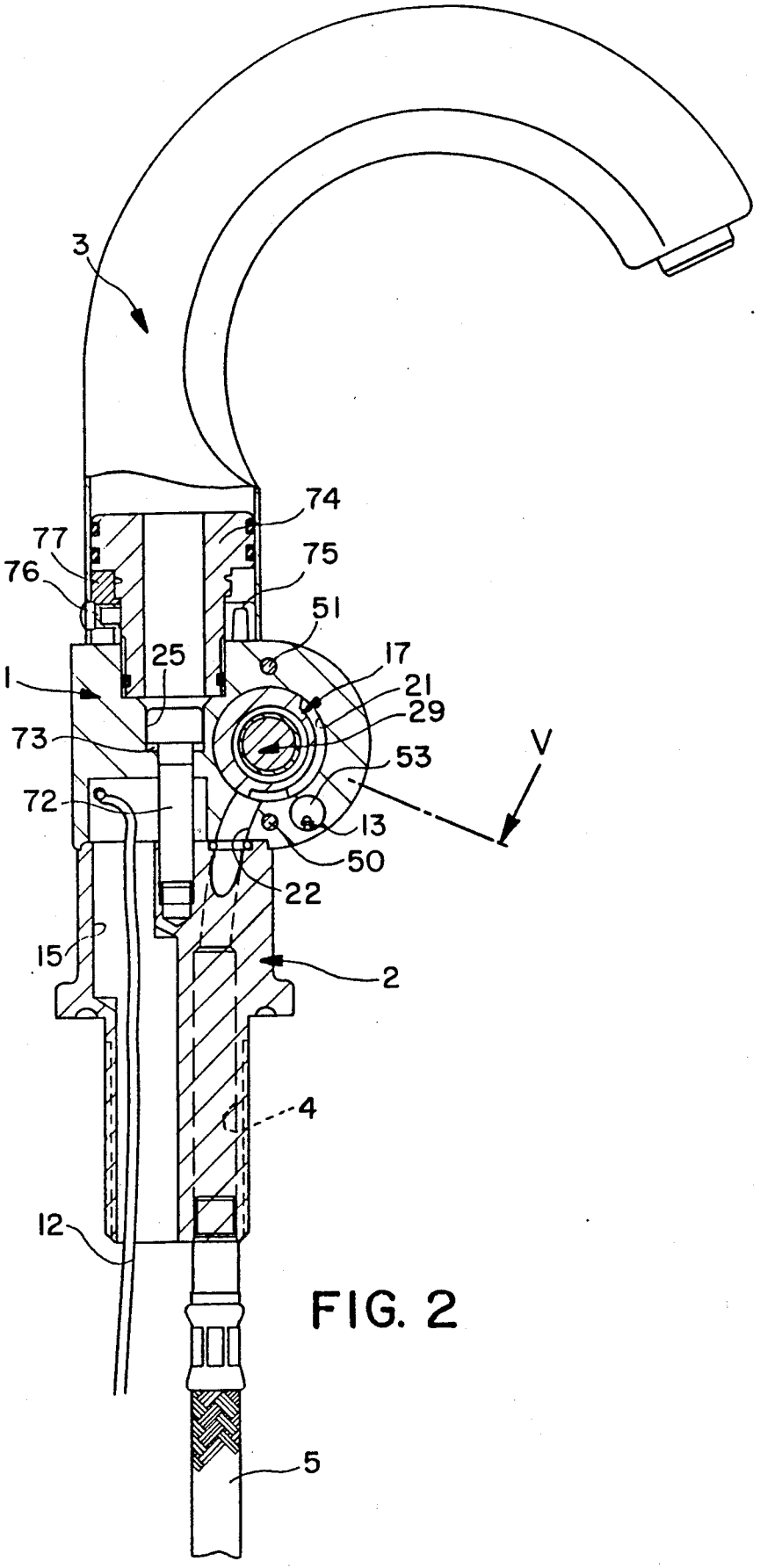
FIG. 2 is a sectional view on line II—II of FIG. 1.

For a more accurate description of what is located in or on the handle-like attachment 7, reference will now be made to FIGS. 4 and 5, which are drawn to a larger scale than FIGS. 1 to 3. The cup-shaped outer housing 18 of the handle-like attachment 7 is omitted in FIGS. 4 and 5 for the sake of clarity. It is attached by a screw 19 to a cylindrical apron 20 of the friction member 17, as can be seen from FIG. 3. When the outer housing 18 is rotated, the entire friction member 17 is thus entrained, which changes the mixing ratio of cold and hot water in a manner to be described hereafter.

The friction member 17 is a one-piece shaped part, which at the end remote from the apron 20 projects into a cylindrical chamber 21 of the main housing 1. Opening into this chamber 21 are bores 22, 23 guided obliquely through the main housing 1 (see also FIG. 5), which communicate with the bores 4 in the base part 2 and through which cold and hot water may thus pass into the cylindrical chamber 21. Staggered axially with respect to the bores 22 and 23, a further bore 24 of the main housing 1 opens into the cylindrical chamber 21, which bore 24 is connected to a vertical bore 25 leading to the outlet 3. This can be seen particularly in FIG. 3. Thus, if the inner end of the friction member 17 were not inserted in the cylindrical chamber 21, then the water flowing in by way of the hoses 5, the channels 4, 22 and 23 into the cylindrical chamber 21 of the main housing 1 could flow directly through the bores 24 and 25 to the outlet 3.

The adjustment of the mixing ratio of cold and hot water takes place by a substantially cylindrical head 26 of the friction member 17, in which an obliquely extending groove 27 is provided. Depending on the rotary position, the groove 27 intersects the channels 22 and 23 in the main housing in a different manner. FIG. 5 shows the position in which equal proportions of cold and hot water are received, because the channels 22 and 23 both open to the same extent, namely up to half, into the groove 27. Therefore water may flow from the channels 22 and 23 into the groove 27. The groove 27 guides the water to be mixed into a recess 28 on the outer periphery of the head 26 of the friction member 17, from where it may pass to the end face of the friction member 17.

An elastic pad 79 is let into the lower region of the surface of the friction member head 26. If the friction member 17 is rotated into the full cold position, the pad 79 lies above the opening of the bore 22 supplying hot water and seals the latter hermetically. Due to this hot water losses are avoided.

The further path of the mixed water arriving at the open end face of the friction member 17, to the channel 24 and thus to the outlet 3 passes by way of the interior of the hollow head 26 of the friction member 17, in which a pilot-controlled valve 29 is located, as well as by way of a radial bore 44 in the friction member 17 and an annular chamber 78, which lies between the wall of the chamber 21 and a region of the friction member 17 of reduced diameter. The annular chamber 78 is limited in the axial direction by two O-rings 56 and 57, which are located in grooves on the surface of the friction member 17.

Without the pilot-controlled valve 29, the water arriving at the inner end face of the head 26 of the friction member 17 could flow freely through the interior of the friction member 17 to the channel 24.

As closing members, the pilot-controlled valve 29 comprises a diaphragm 30 of resilient material as well as a cage 31 of rigid synthetic material, with which the diaphragm 30 cooperates. This is shown in one piece in the drawing, but could also be constructed in several pieces.

The resilient diaphragm 30 is in the shape of two truncated cones placed one on the other in opposite directions, beads 32, 33 projecting radially inwards being formed on the axially opposing ends.

The cage 31 comprises a central abutment member 34 as well as respectively one support ring 35 or 36 at the two axial ends, which ring cooperates with the bead 32, 3 located there of the resilient diaphragm 30. The abutment member 34 of the cage 31 is connected by ribs 37 to the support rings 35, 36 to form one unit.

The cage 31 and diaphragm 30 attached thereto bear against a step in the inside of the friction member and are secured detachably at the outer end by a packing 46 and a spring ring 47. The resilient diaphragm 30 is shaped so that normally, thus without the action of pressure by water, from the inside or outside, it bears against the outside of the abutment member 34 of the cage 31. This is the closed state of the pilot-controlled valve 29, since then the water path through the interior of the friction member 17 to the channel 24 is blocked by the abutment member 34 and the diaphragm 29.

The diaphragm 29 is able to move from the closed position illustrated into an open position, in that it lifts in the central region from the abutment member 34 and bears against the wall of the cylindrical chamber 21 of the main housing 1. In this case an annular chamber between the diaphragm 29 and the abutment member 34 is released for throughflow.

This movement of the diaphragm 30 takes place under the influence of the pressures, which exist radially inside and radially outside the latter. These processes are known per se and do not need to be explained here in detail. In the present context, it is sufficient to know the following:

The interior of the diaphragm 29 lying below the abutment member 34 is connected by a small radial equalizing bore 38 to the outer chamber. The latter once more communicates by way of an axis parallel channel 39 with a recess 40 on the outer end face of the friction member 17 lying radially within the apron 20. The recess 40 is covered by the under side of the magnetic coil 14 and sealed by an O-ring 45. Formed on the base of the recess 40 is a valve seat 41, which cooperates with a closing member 42. The closing member 42 normally closes the valve seat 41 and thus access to an axis parallel channel 43, which leads to the radial bore 44 in the friction member 17 and thus to the channel 24 in the main housing 1.

Figure 4:
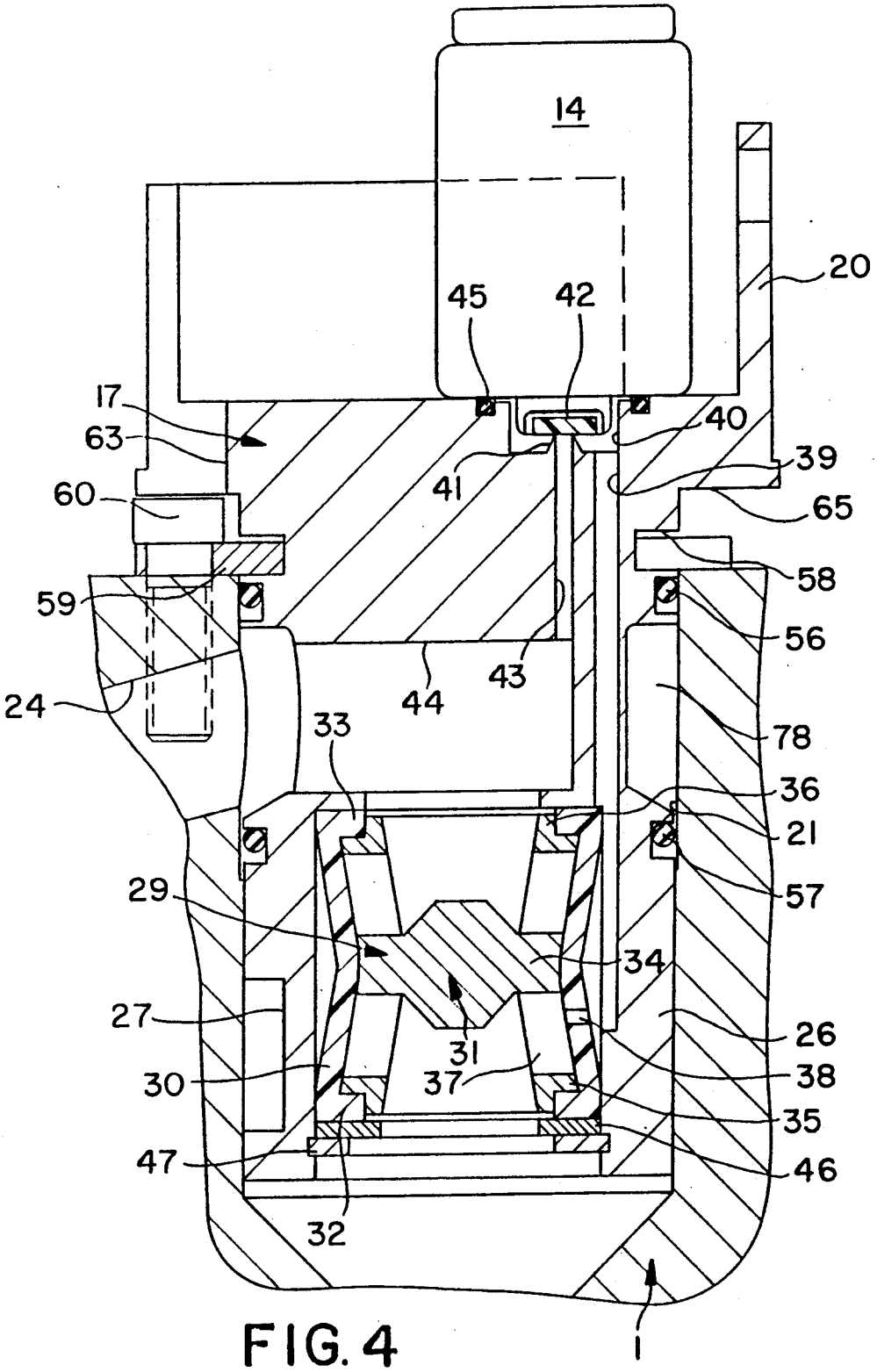
FIG. 4 is a cutaway view from FIG. 3, to an enlarged scale.
Figure 5:
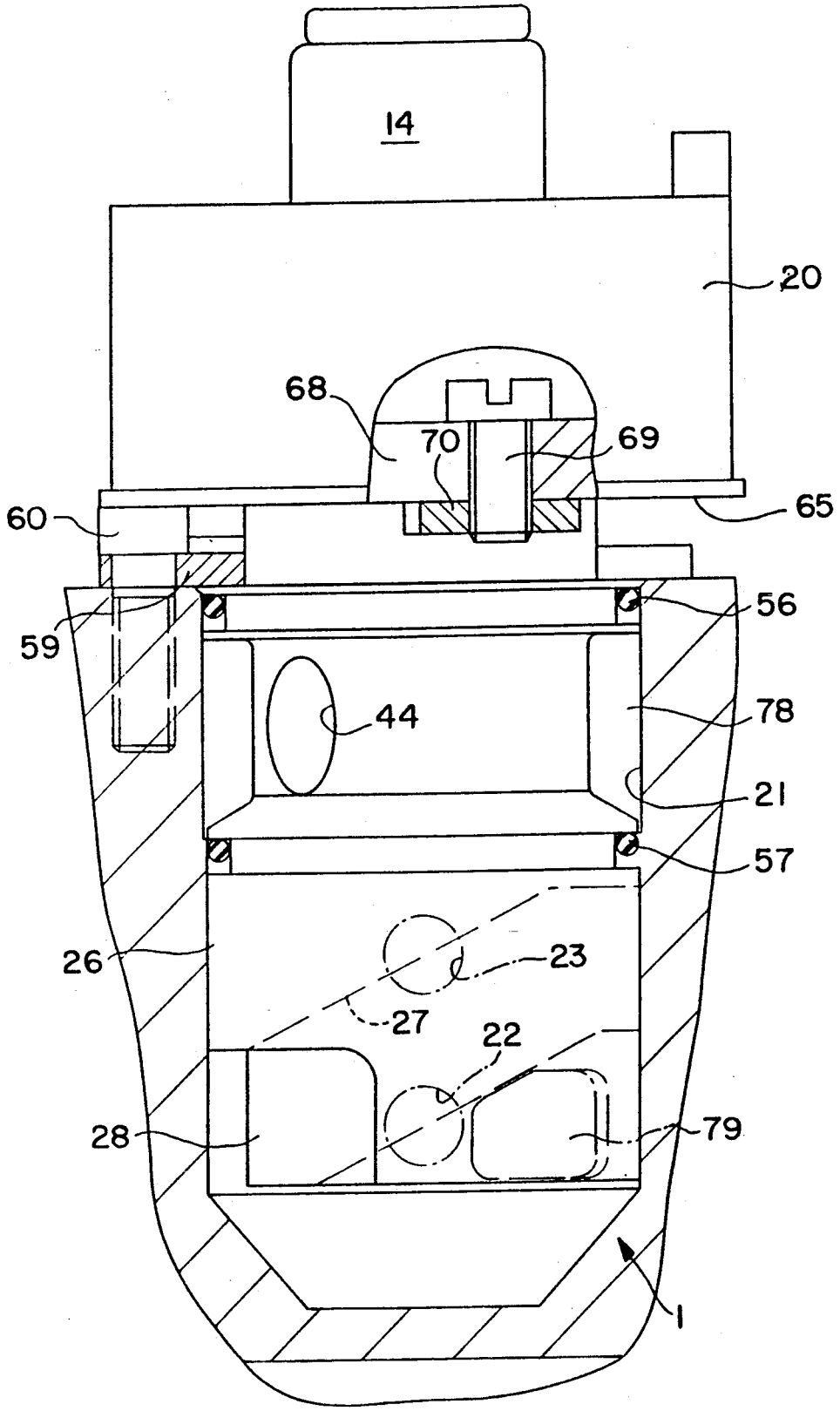
FIG. 5 is a view, similar to FIG. 4, but in section in the direction of arrow V in FIG. 2 (rotary piston not shown in section)
Figure 6:
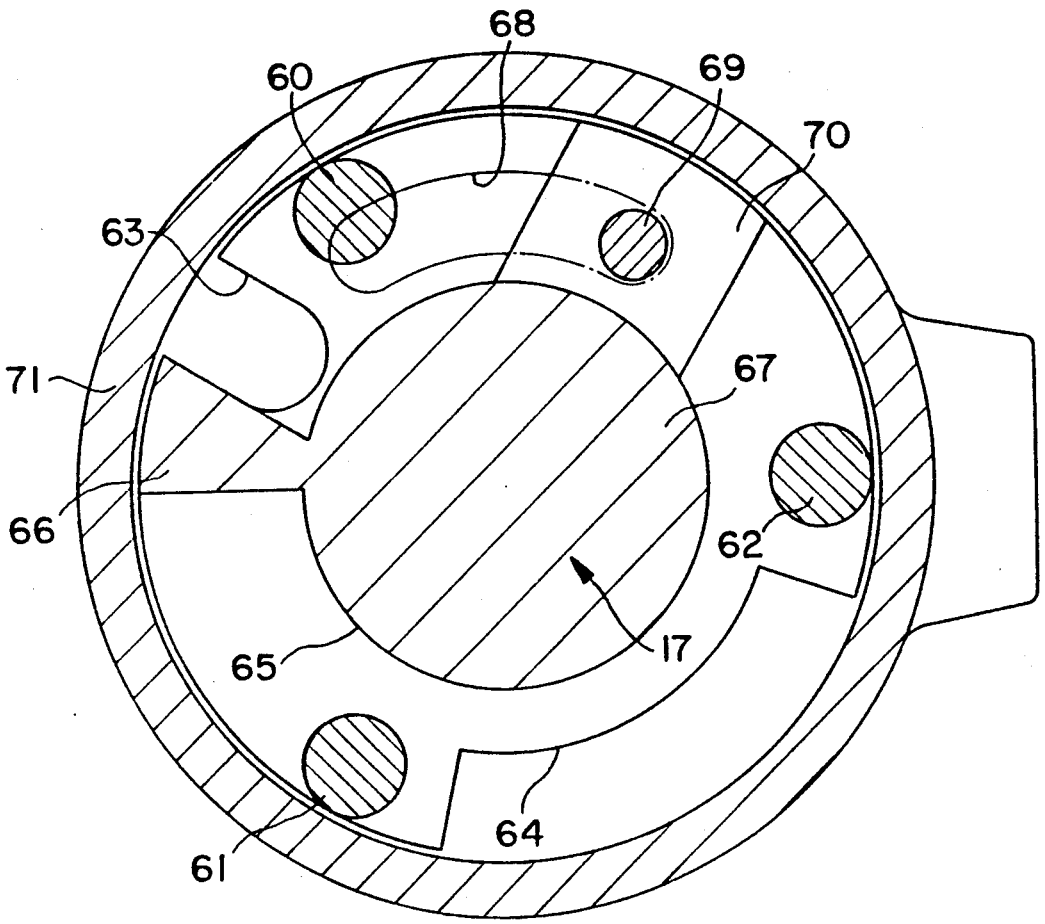
FIG. 6 is a sectional view on line VI—VI of FIG. 3, to an enlarged scale.

As long as the closing member 42 closes the valve seat 41, as is shown in FIG. 4, the compressive force acting from outside on the resilient diaphragm 30 is greater than the resulting compressive force prevailing in the inner chamber of the diaphragm 29. The diaphragm 30 therefore remains in contact with the outer periphery of the abutment member 34 of the cage 31; the pilot-controlled valve 29 is closed.

However, if current is supplied to the coil 14 of the pilot-controlled valve, the closing member 42 lifts from the valve seat 41. This results in a change of the pressures acting on the diaphragm 30 in the sense that the diaphragm 30 lifts from the abutment member 34 in the central region and moves into the open position, in which it bears against the inner wall of the head 26 of the friction member 17.

At the time of assembly of the sanitary fitting controlled in a non-contacting manner, first of all the units held or formed by the handle-like attachments 6 and 7 are pre-assembled.

For the handle-like attachment 6 this means that the emitting diode 9 as well as the receiving diode 10 and the electronics 11 are introduced and attached in its housing 52 from the open end. At its open end, the housing 52 has a screw thread, into which a ring 49 is screwed. Two screws 50, 51 (see also FIG. 2) extend transversely through the main housing 1 and are rotated by their threaded end into threaded bores of the ring 49. The heads of the screws 50, 51 thus bear against a recess in the side face of the main housing 1 on the right in FIG. 1. The left-hand handle-like attachment 6 is thus attached to the main housing 1. Due to the use of the ring 49 and of the screws 50, 51, it is possible to fix the angular orientation of the housing 52 and thus the alignment of the optical window 8 accurately, which would not be possible if the housing 52 of the left-hand handle-like attachment 6 was simply screwed by the end into the main housing 1.

Before the final fixing of the handle-like attachment 6 to the main housing 1, naturally the cable 12 is guided through the channels 15 and 16; the cable 13 is guided through a channel 53 completely penetrating the main housing 1 (see also FIG. 2) to the other side face of the main housing 1.

A cylindrical collar 54 on the inner end of the housing 52 projects into a groove on the side face of the main housing 1 on the left in FIG. 1. This produces a visually attractive transition between the handle-like attachment 6 and the main housing 1.

The fastening of the handle-like attachment 7, on the right in FIG. 1, which in fact is a genuine handle, takes place in the following manner (the following description refers in particular to FIGS. 3 to 6):

The frictional member 17 is provided with a groove 58 at that axial point where, in the installed state, the side face of the main housing 1 on the right in FIG. 1 comes to lie. A U-shaped fastening part 59 is inserted from the side in this groove 58. This fastening part is screwed securely by three screws 60, 61 and 62 to the side face of the main housing 1 on the right in FIG. 1. One of these screws, namely the screw 60, is illustrated in FIGS. 4 and 5; all three screws can be seen in FIG. 6, which is a section on line VI—VI of FIG. 3, at the height of the heads of the screws 60, 61, 62. The heads of the screws 60, 61, 62 are accessible through recesses 63, 64, which extend axis parallel through the outer part of the friction member 17 up to the end face on the right in FIG. 1. Due to rotation of the friction member 17, these recesses 63, 64 may be brought alternately into alignment with the heads of the screws 60, 61, 62, so that the screws 60, 61, 62 can be inserted at this point and tightened with a screwdriver.

The angle by which the friction member 17 can be rotated for adjusting the temperature of the mixed water flowing out, is adjustable in the following manner:

Directly adjoining the outside of the groove 58 (thus in FIG. 4 above the latter) a further recess 65 is provided in the outer contour of the friction member 17, but which recess has a greater diameter than the groove 58 and is not guided completely around the periphery of the friction member 17. On the contrary, as can be seen from FIG. 6, a dove-tailed projection 66 projects radially outwards from the "core" 67 of the friction member 17. This dove-tailed projection 66 restricts the ability of the friction member 17 to rotate in clockwise direction in FIG. 6, in that it comes to bear against the head of the screw 60.

A curved slot 68 passes through the wall between the annular shoulder, which is formed by the recess 65 towards the partial region of the friction member 17 supporting the apron 20, and the outer end wall of the friction member 17 surrounded by the apron 20, on which the magnetic coil 14 is also fitted. A screw 69 is guided from outside through this slot 68, which screw secures a stop member 70 on the aforementioned annular shoulder of the recess 65. The stop member 70 extends radially from the "core" 67 of the friction member 17 towards the outer periphery of the annular shoulder formed by the recess 65. It restricts the ability of the friction member 17 to rotate in counterclockwise direction, in that it comes to bear against the head of the screw 60. As is shown, the entire angle of rotation, which the frictional member 17 is able to cover, is defined by the variable position of the stop member 70 in the curved slot 68.

If the friction member 17 with the pilot-controlled valve 29 located therein and the magnetic coil 14 actuating the latter is fixed by means of the U-shaped fastening part 59 and the screws 60 to 62 to the main housing 1, the housing 18 is slid onto the apron 20 of the friction member 17 and fastened there by a screw 19. A cylindrical collar 71 screwed to the housing 18, which could also be in one piece with the housing 18, thus engages in a groove in the side face of the main housing 1 on the right in FIG. 1. In this respect the conditions are identical to the manner in which the outer housing 52 of the handle-like attachment 6, on the left in FIG. 1, engages in a groove on the left-hand side face of the main housing 1.

Finally, the head of the screw 19 in the handle 18 is covered by a window 48, whereof the appearance corresponds to the window 8 in the handle-like attachment 6 on the left in FIG. 1. As can be seen from FIG. 1, a completely symmetrical appearance is thus provided externally.

The main housing 1 is attached to the base part 2 by a central screw 72 (FIG. 2), whereof the head lies in the upper region in the aforementioned bore 25, which guides mixed water flowing from the cylindrical chamber 21 to the outlet 3. The path of the water in a downwards direction is blocked in FIG. 2 by a gasket 73, which is located between the head of the screw 72 and the annular shoulder of the bore 25 located therebelow.

For fastening the outlet 3 to the main housing 1, a fixing socket 74 is screwed into the latter from above. In the upper region, the fixing socket 74 has a somewhat larger diameter and in this case bears by way of O-rings against the inner wall of the outlet 3. The latter is pushed over the fixing socket 74 close up to the upper end face of the main housing 1. A U-shaped fixing part 75 lies between the inner wall of the outlet 3 and the region of the fixing socket 74 of reduced diameter. The outlet 3 is fixed thereto by means of a screw 76. The fixing part 75 bears by a projection 77 extending in the axial direction, against an annular step, which connects the region of the fixing socket 74 of enlarged diameter to the region of smaller diameter. Due to this the outlet 3 is fixed in the axial direction. Due to corresponding profiling of the outer contour of the fixing socket 74, the axial projection 77 simultaneously acts as a limitation for the angle of rotation, which the outlet 3 may traverse with respect to the main housing 1.

We claim:

1. Sanitary fitting controlled in a non-contacting manner, with a housing, in which are located:

a) substantially electronic components, in particular a transmitter, a receiver and an electronic switching circuit, which in a non-contacting manner ascertain the presence of a user in a detection range and after this produce an output signal;

b) substantially mechanical components, in particular an electrically controlled valve, which control the flow of water depending on the output signal of the electronic components and possibly other limiting quantities, characterised in that c) the housing comprises a main housing (1) containing the water channels (22 to 25) and two handle-like attachments (6, 7) releasably attached symmetrically with respect to a central plane (II—II), each with a substantially cup-shaped housing (18, 52);

d) all the electronic components (9, 10, 11) are held in the manner of a standard construction by one of the handle-like attachments (6) and are located at least partly in its cup-shaped housing (52);

e) all the mechanical components (14, 17, 29) are held in the manner of a standard construction by the other of the handle-like attachments (7) and are located at least partly in its cup-shaped housing (18).

2. Sanitary fitting according to claim 1, characterised in that at least one of the handle-like attachments (6) is attached to the main housing (1) in a non-rotatable manner.

3. Sanitary fitting according to claim 2, characterised in that a fastening ring (49) is releasably attached in the open end of the housing (52) of the non-rotatable attachment (6) and that the fastening ring (49) is screwed to one side face of the main housing (1).

4. Sanitary fitting according to claim 3 characterized in that screws (50) are associated with the fastening ring (49) and extend transversely through the main housing (1).

5. Sanitary fitting according to claim 1, characterised in that at least one of the handle-like attachments (7) is rotatable and in this respect serves as a genuine handle.

6. Sanitary fitting according to claim 5, characterised in that the rotatable handle-like attachment (7) holds a rotary piston (17), which projects into a chamber (21) of the main housing (1) by its region (26) controlling the flow of cold and hot water.

7. Sanitary fitting according to claim 6, characterised in that the rotary piston (17) is constructed as a hollow piston and at least the closing members (30, 34) of the electrically controlled valve (14, 29) are located inside the hollow piston (17).

8. Sanitary fitting according to claim 5, characterised in that the rotatable handle-like attachment (7) is screwed to the main housing (1) by means of a U-shaped fastening part (59), which engages in a groove (58) on a mechanical component (17) held by the rotatable attachment (7).

9. Sanitary fitting according to claim 8, characterised in that the component (17) comprising the groove (58) comprises recesses (63, 64) leading to one side face, which recesses may be brought into alignment with the fastening screws (60, 61, 62) for the U-shaped fastening part (59).

10. Sanitary fitting according to claim 5, characterised in that one of the mechanical components (17) held on the rotatable attachment (7) comprises a recess (65), which forms a shoulder (66) projecting radially from a core (67) of the component (17), this shoulder (66), by abutment against a stationary part (60), limiting the rotatability of the handle-like attachment (7) at least in one direction of rotation.

11. Sanitary fitting according to claim 10, characterised in that a stop member (70) may be attached to an annular shoulder of the recess (65) in different angular positions, which stop member by abutment against a stationary part (60), limits the rotatability of the attachment (7) in one direction of rotation.

12. Sanitary fitting according to claim 10, characterised in that the stationary part (60) is a fastening screw for mounting the rotatable attachment (7) on the main housing (1).

13. Sanitary fitting according to claim 1, characterised in that the cup-shaped housings (18, 52) of the handle-like attachments (6, 7) engage by their open end or by a collar (71) extending the latter, in a groove on the adjacent side face of the main housing (1).

14. Sanitary fitting according to claim 1, characterised in that the main housing (1) is attached to the base part (2) by a central screw (72).

15. Sanitary fitting according to claim 14, characterised in that the separating points between the inflow channels (4, 5) and the bores (22, 23) are provided with suitable seals and the head of the central screw (72) is sealed with respect to the main housing by a gasket (73).

* * * * *